US010072534B2

(12) United States Patent
Suzuki

(10) Patent No.: US 10,072,534 B2
(45) Date of Patent: Sep. 11, 2018

(54) LASH ADJUSTER

(71) Applicant: OTICS CORPORATION, Nishio-shi, Aichi (JP)

(72) Inventor: Hiroyuki Suzuki, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 197 days.

(21) Appl. No.: 15/083,788

(22) Filed: Mar. 29, 2016

(65) Prior Publication Data

US 2016/0290179 A1 Oct. 6, 2016

(30) Foreign Application Priority Data

Apr. 2, 2015 (JP) ..... 2015-075669

(51) Int. Cl.
*F01L 1/18* (2006.01)
*F01L 1/24* (2006.01)

(52) U.S. Cl.
CPC ..... *F01L 1/2405* (2013.01); *F01L 1/24* (2013.01); *F01L 2103/00* (2013.01)

(58) Field of Classification Search
CPC ..... F01L 1/24; F01L 1/2405; F01L 2103/00
USPC ..... 123/90.39, 90.45, 90.46
See application file for complete search history.

(56) References Cited

U.S. PATENT DOCUMENTS

| | | | |
|---|---|---|---|
| 2,175,467 | A | 10/1939 | Johnson |
| 3,273,548 | A | 9/1966 | Hoffman |
| 2005/0178351 | A1 | 8/2005 | Mayer et al. |

FOREIGN PATENT DOCUMENTS

| | | | |
|---|---|---|---|
| DE | 102005022456 | A1 | 11/2006 |
| JP | H01-114903 | U | 8/1989 |
| JP | H04-021708 | U1 | 2/1992 |
| JP | H06-212917 | A | 8/1994 |
| JP | 2003-336507 | A | 11/2003 |
| JP | 2005-002953 | A | 1/2005 |
| JP | 2011-001907 | A | 1/2011 |

OTHER PUBLICATIONS

European Search Report dated Sep. 9, 2016 in European Patent Application No. 16 000 591.4 (6 pages).
Japanese Office Action dated Jun. 26, 2018 in JP 2015-075669 (3 pages in Japanese with English translation).

*Primary Examiner* — Ching Chang
(74) *Attorney, Agent, or Firm* — Smith, Gambrell & Russell, LLP

(57) ABSTRACT

A lash adjuster includes a body which is cylindrical in shape and a plunger. The plunger is reciprocably inserted into the body and has an interior in which a low-pressure chamber is defined. The plunger has a bottom wall defining a high-pressure chamber in conjunction with the body between them and a peripheral wall formed with a plunger oil hole through which an operating oil is fed into the low-pressure chamber. The bottom wall is formed with a valve hole through which the operating oil stored in the low-pressure chamber is allowed to flow into the high-pressure chamber. The plunger has a pocket provided on the peripheral wall so as to be deformed toward the low-pressure chamber and inclined in an upward direction, defining the plunger oil hole.

9 Claims, 5 Drawing Sheets

LASH ADJUSTER

CROSS-REFERENCE TO RELATED APPLICATIONS

This application is based upon and claims the benefit of priority from the prior Japanese Patent Application No. 2015-75669 filed on Apr. 2, 2015, the entire contents of which are incorporated herein by reference.

BACKGROUND

1. Technical Field

The present invention relates to a lash adjuster.

2. Related Art

Japanese Patent Application Publication No. JP-A-2005-2953 discloses a lash adjuster which includes a bottomed cylinder (body) and a bottomed cylindrical plunger which is reciprocably inserted into the cylinder. A low-pressure chamber is defined in the plunger, and a high-pressure chamber is defined between the cylinder and a bottom wall of the plunger in the cylinder. The bottom wall of the plunger is formed with a valve orifice, and the high-pressure chamber houses parts composing a check valve mechanism, such as a valve portion which opens and closes the valve orifice, and the like.

An oil feed pipe is mounted on the plunger so as to extend through a peripheral wall thereof. The oil feed pipe is disposed to protrude obliquely upward into the low-pressure chamber. The oil feed pipe has an upper end reaching the vicinity of a top of the plunger. An operating oil from the cylinder head side is fed through the oil feed pipe into the low-pressure chamber thereby to be stored in the low-pressure chamber. When fluctuations in hydraulic pressure cause the valve portion to depart from the valve orifice of the bottom wall, the operating oil stored in the low-pressure chamber is fed through the valve orifice into the high-pressure chamber.

The above-described construction can render the lash adjuster smaller in size. Even when the low-pressure chamber cannot ensure a sufficient inner volume, the operating oil in the low-pressure chamber is stored up to a height position corresponding to the upper end of the oil feed pipe. This can prevent air in the low-pressure chamber from being suctioned into the high-pressure chamber due to shortage of operating oil in the low-pressure chamber. In particular, when the lash adjuster is inclined relative to the horizontal direction due to a mounting angle of engine, stop of a vehicle on a slope or the like, an amount of operating oil in the low-pressure chamber is reduced to a significant degree if no oil feed pipe or equivalent thereto is provided. Therefore, there is a great advantage in employment of the foregoing construction.

However, the oil feed pipe is added as an additional part of the lash adjuster in the above-described construction. This increases the number of parts and complicates the parts control. Additionally, a work of mounting the oil feed pipe to the peripheral wall has a possibility of causing works hardship.

SUMMARY

Therefore, an object of the invention is to provide a lash adjuster which can cope with size reduction, inclined mounting and the like without increase in the number of parts.

The invention provides a lash adjuster including a body which is cylindrical in shape and a plunger. The plunger is reciprocably inserted into the body and having an interior in which a low-pressure chamber is defined. The plunger has a bottom wall defining a high-pressure chamber in conjunction with the body between them and a peripheral wall formed with a plunger oil hole through which an operating oil is fed into the low-pressure chamber. The bottom wall is formed with a valve hole through which the operating oil stored in the low-pressure chamber is allowed to flow into the high-pressure chamber. The plunger has a pocket provided on the peripheral wall of the plunger so as to be deformed toward the low-pressure chamber and so as to be inclined in an upward direction, thereby defining the plunger oil hole.

A surface level of the operating oil in the low-pressure chamber is defined by an upper end opening of the pocket which is formed so as to be deformed and inclined in the upward direction toward the low-pressure chamber. This construction can increase an amount of operating oil in the low-pressure chamber as compared with a case where the plunger oil hole is formed merely to extend through the peripheral wall in the thicknesswise direction. As a result, a sufficient amount of operating oil can be ensured in the low-pressure chamber even under the condition that the operating oil is hard to store in the low-pressure chamber due to size reduction in a vehicle, inclined mounting or the like. Further, since the pocket is formed integrally with the peripheral wall, there is no increase in the number of parts from conventional lash adjusters. The surface level of the operating oil in the low-temperature chamber refers to an uppermost surface level of the operating oil which can be supplied to the low-pressure chamber when the operating oil is supplied to the low-pressure chamber or when the engine is started. The surface level during the driving of the engine sometimes exceeds or falls below the above-mentioned surface level.

DETAILED DESCRIPTION

First Embodiment

Figure 1:
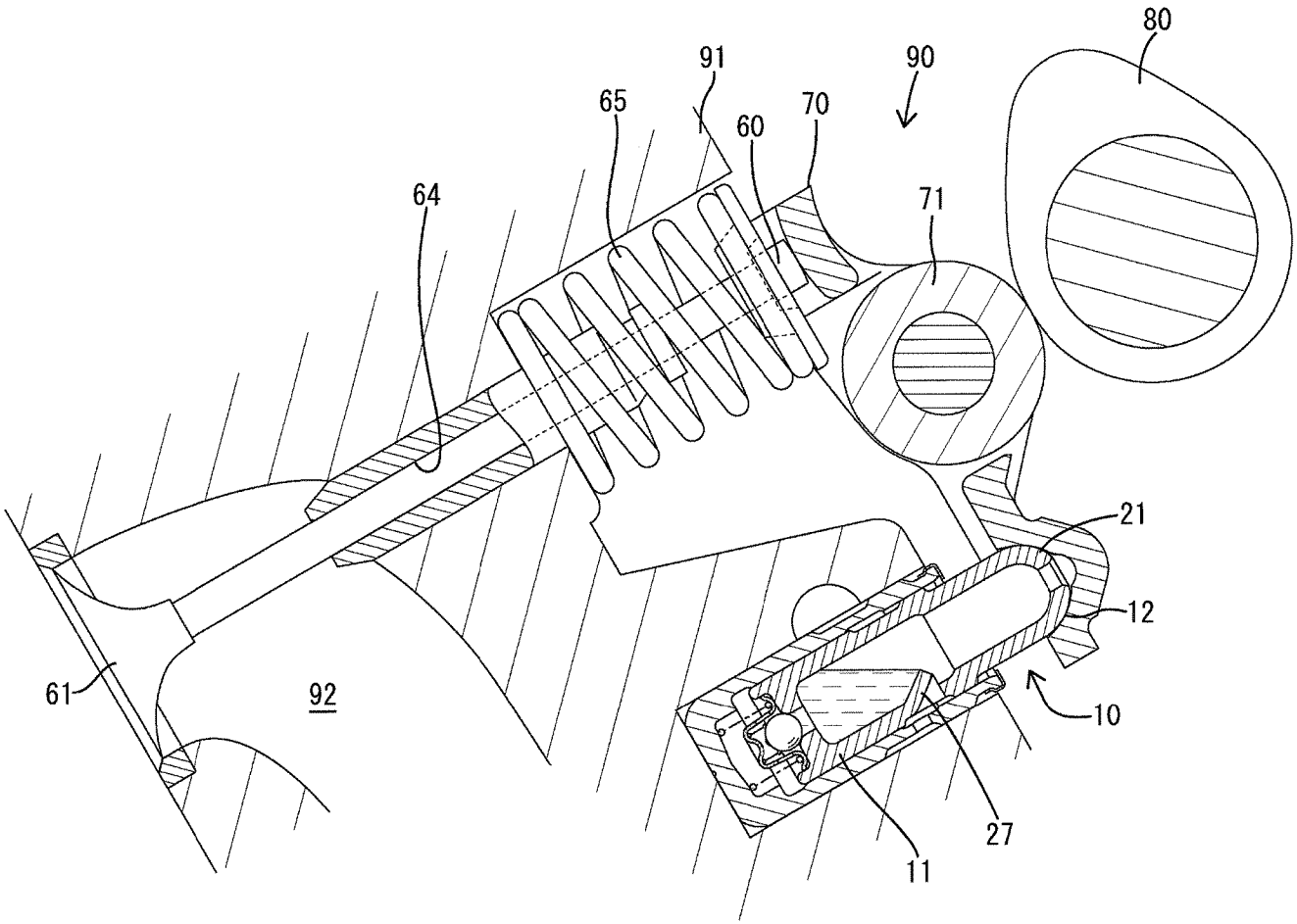
FIG. 1 is a cross sectional view of the lash adjuster of an embodiment, incorporated into a cylinder head.

A first embodiment will be described with reference to FIGS. 1 to 4. Referring now to FIG. 1, a hydraulic lash adjuster 10 is shown which is mounted on a valve gear 90 of a horizontally-opposed or inclined engine in order to automatically adjust a valve clearance between a cam 80 and a rocker arm 70. In the following description, up-down, horizontal, and vertical directions are based on the case where the lash adjuster 10 is mounted on a vehicle.

The valve gear 90 opening and closing a suction or exhaust port 92 of a cylinder head 91 includes a cam 80 rotated in synchronization with an engine, a valve stem 60 formed integrally with a valve body 61, a rocker arm 70 rocked according to rotation of the cam 80 to press the valve stem 60, and the lash adjuster 10 rockably supporting one end of the rocker arm 70, as shown in FIG. 1.

The valve stem 60 is inserted into a stem guide hole 64 continuous to the suction or exhaust port 92 and biased by a coil spring in a direction such that the suction or exhaust port 92 is closed by the valve body 61. Upon rotation of the cam 80, the rocker arm 70 is rocked and the valve stem 60 is reciprocated in the stem guide hole 64 in an up-down direction, whereby the suction or exhaust port 92 is opened and closed by the valve body 61.

The rocker arm 70 has two ends, the one of which is supported by the lash adjuster 10 as described above and the other of which abuts against the valve stem 60. The cam 80 is rotatably brought into contact with a roller 71 mounted between the ends of the rocker arm 70. The rocker arm 70 is disposed with an axis line thereof being inclined relative to a horizontal direction.

Figure 2:
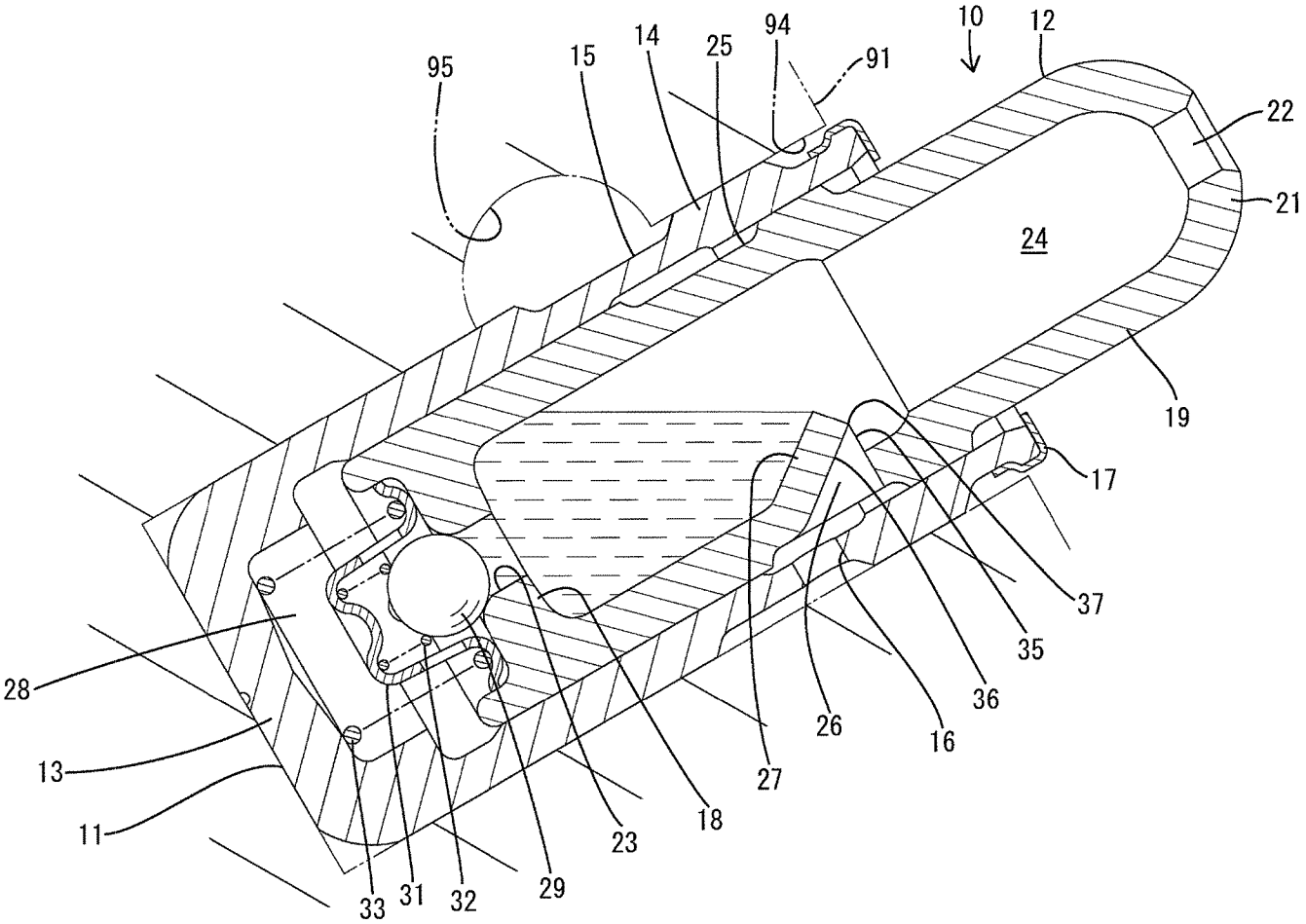
FIG. 2 is an enlarged view of the lash adjuster as shown in FIG. 1.

The lash adjuster 10 is smaller in size than conventional lash adjusters and is inserted into a bottomed mounting hole 94 formed in the cylinder head 91 and having a circular cross section, as shown in FIG. 2. The lash adjuster 10 is disposed in an inclined state in the horizontal direction while inserted into the mounting hole 94. The lash adjuster 10 includes a cylindrical body 11 and a cylindrical plunger 12 which is inserted into the body 11 so as be reciprocable in the up-down direction that is an axial direction and in more detail, a direction of inclination relative to the vertical direction.

The body 11 includes a disc-shaped end wall 13 and a cylindrical wall 14 rising from an outer peripheral edge of the end wall 13. The cylindrical wall 14 has an outer periphery formed with a body circumferential groove 15 extending over an entire circumference. A body oil hole 16 open in an inner surface of the body circumferential groove 15 is formed to extend through the cylindrical wall 14 in the thicknesswise direction (radial direction). The cylindrical wall 14 has an open end (an upper end) to which is mounted a retainer 17 preventing the plunger 12 from coming out of the body 11.

Figure 3:
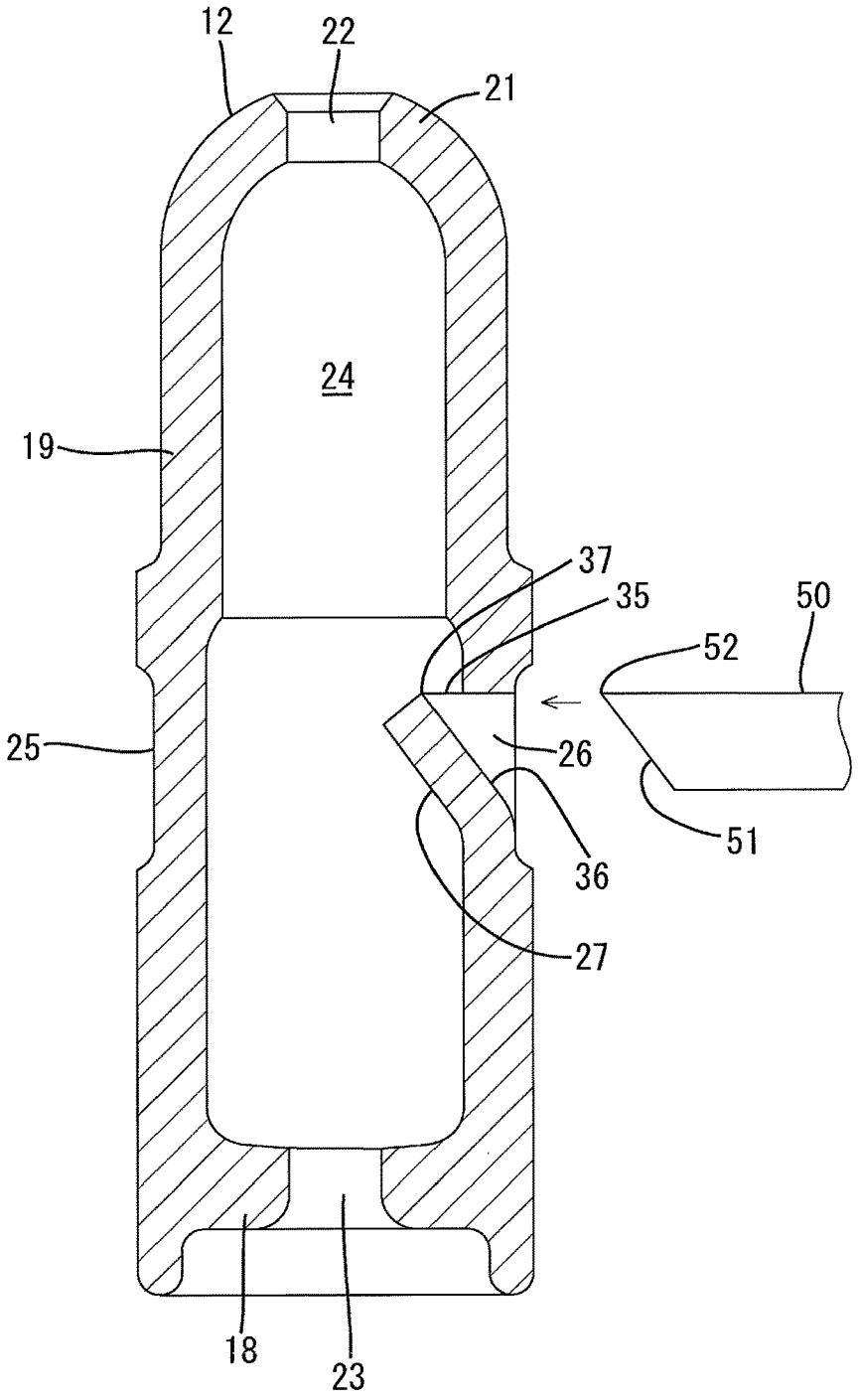
FIG. 3 is a diagrammatic view explaining a method of manufacturing a plunger of the lash adjuster.

The plunger 12 includes a cylindrical bottom wall 18 and a peripheral wall 19 rising from an outer peripheral edge of the bottom wall 18, as shown in FIG. 3. The peripheral wall 19 has an upper end formed into a spherical portion 21 narrowed into a semispherical shape. In a state where the plunger 12 is inserted into the body 11, the spherical portion 21 protrudes upward from an upper end of the body 11, so that an end of the rocker arm 70 is adapted to be slidably supported on a semispherical outer periphery of the spherical portion 21 as shown in FIG. 1. The spherical portion 21 includes a radially central part that is an upper end thereof and a top opening 22 which is circular in cross section and extends through the radially central part, as shown in FIG. 3. Further, the bottom wall 18 includes a radially central part formed with a valve hole 23 circular in cross section. The valve hole 23 is located to be coaxial with the top opening 22 with respect to the up-down direction and extends through the radially central part of the bottom wall 18. The plunger 12 has an interior defined as a low-pressure chamber 24.

The peripheral wall 19 of the plunger 20 has an outer periphery which is slidable on an inner periphery of the cylindrical wall 14 of the body 11 and is formed with a plunger circumferential groove 25, as shown in FIG. 2. The plunger circumferential groove 25 is located to be opposed to the inner periphery of the cylindrical wall 14 and extends over an entire outer periphery of the peripheral wall 19. Further, the peripheral wall 19 has a plunger oil hole 26 which extends therethrough and is open in an inner surface of the plunger circumferential groove 25. The plunger oil hole 26 is defined by a pocket 27 formed by deforming a part of the peripheral wall 19 toward the low-pressure chamber 24. The pocket 27 will be described in detail later.

The mounting hole 94 communicates with an oil supply hole 95 of the cylinder head 91 as shown in FIG. 2. A fluid, such as an operating oil, supplied through the oil supply hole 95 is stored in the low-pressure chamber 24 through the body circumferential groove 15, the body oil hole 16, the plunger circumferential groove 25 and the plunger oil hole 26 in sequence.

A high-pressure chamber 28 is defined by the end wall 13, the cylindrical wall 14 and the bottom wall 18 of the plunger 12 in a lower interior of the body 11. In the high-pressure chamber 28 are provided a spherical valving element 29, a cage 31 holding the valving element 29, a first spring 32 comprising a compression coil spring housed in the cage 31 to bias the valving element 29 to the valve hole 23 side, and a second spring 33 comprising a compression coil spring interposed between a peripheral edge of the cage 31 and the end wall 13 to bias the plunger 12 to the rocker arm 70 side. The valving element 29 is reciprocable so as to come into contact with and depart from the valve hole 23 depending upon pressure difference between the low-pressure and high-pressure chambers 24 and 28. The operating oil in the low-pressure chamber 24 flows through the valve hole 23 into the high-pressure chamber 28 when the valving element 29 is moved in a direction such that the valving element 29 departs from the valve hole 23 against a biasing force of the first spring 32.

Furthermore, when the rocker arm 70 is pressed from the cam 80 side upon rotation of the cam 80, the plunger 12 is pressed by one end of the rocker arm 70 thereby to be moved down into the body 11. Consequently, the operating oil in the high-pressure chamber 28 is compressed with the result that the pressure in the high-pressure chamber 28 is increased. With increase in the pressure in the high-pressure chamber 28, a slight amount of operating oil in the high-pressure chamber 28 flows into the plunger circumferential groove 25 through a gap between the inner periphery of the cylindrical wall 14 and the outer periphery of the peripheral wall 19. As a result, the whole length of the lash adjuster 10 is reduced according to an amount of operating oil having flowed out of the high-pressure chamber 28. Further, the pressure increase in the high-pressure chamber 28 rigidifies the body 11 and the plunger 12, whereby the lash adjuster 10 can support the rocker arm 70 at a predetermined position.

When further rotation of the cam 80 reduces the pressure acting on the rocker arm 70 from the cam 80 side, the plunger 12 is raised by the pressure in the high-pressure chamber 28 and the biasing force of the second spring 33 thereby to protrude from the open end of the cylindrical wall 14 of the body 11 to a large extent. In this case, the pressure in the high-pressure chamber 28 is reduced, resulting in a pressure difference between the low-pressure and high-pressure chambers 24 and 28. Consequently, the valving element 29 is opened against the biasing force of the first spring 32. The operating oil in the low-pressure chamber 24 flows into the high-pressure chamber 28 simultaneously with the opening of the valving element 29. The whole length of the lash adjuster 10 is increased according to an amount of operating oil having flowed into the high-pressure chamber 28. This secures a state where the lash adjuster 10 supports the rocker arm at an appropriate position, with the result that a valve clearance between the cam 80 and the rocker arm 70 is adjusted so as to be reduced to substantially zero.

Figure 4:
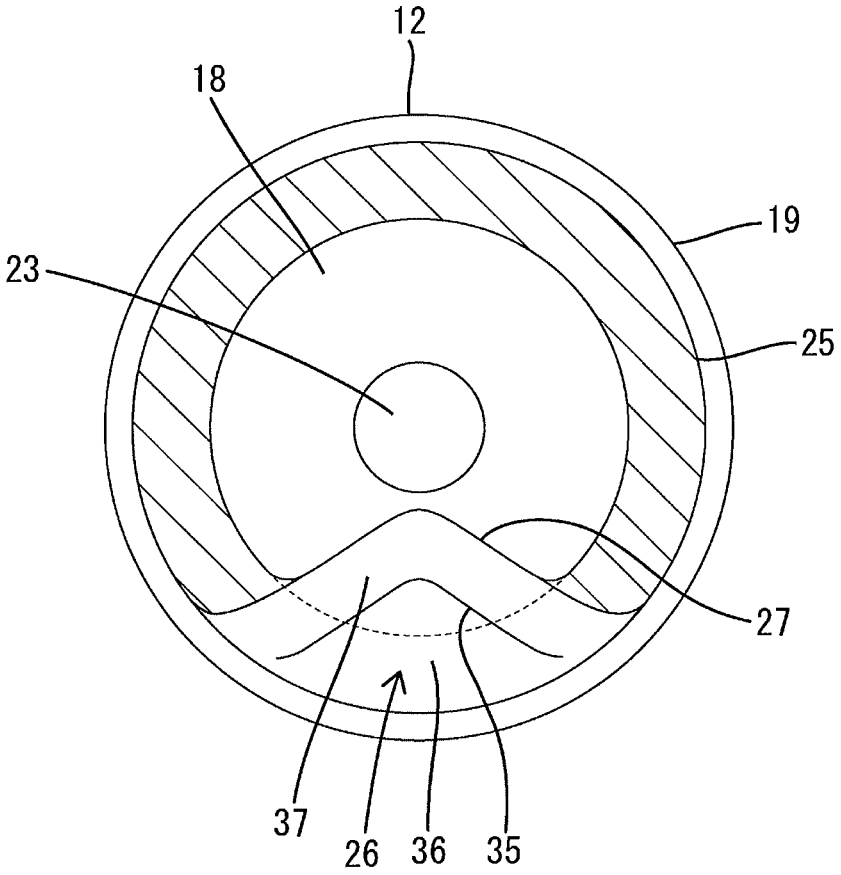
FIG. 4 is a cross sectional view of a part of the plunger, corresponding to a plunger oil hole.

The pocket 27 includes a cutout 35 which is substantially triangular in a planar view and is formed by cutting out the plunger circumferential groove 25 of the peripheral wall 19 in a circumferential direction (a direction perpendicular to the axial direction of the plunger 12), as shown in FIG. 4. The cutout 35 serves as an upper end opening 37 of the pocket 27. Additionally, the pocket 27 is configured so that a section thereof as viewed in a side view is formed into a linear shape such that the section gradually protrudes upward into the low-pressure chamber 24, as shown in FIG. 2. The upper end opening 37 of the pocket 27 is located so as to be continuous at an equal level in the peripheral wall 19 having an axis line directed in the up-down direction.

The pocket 27 has a recessed outer surface which is formed into an oil passage 36 for the operating oil passing through the plunger oil hole 26, as shown in FIG. 2. The oil passage 36 is located to face the body circumferential groove 15 in the state where the plunger 12 is inserted into the body 11. The oil passage 36 is inclined with a rising slope toward the upper end opening 37 and has a linear cross section. The pocket 27 is formed together with the plunger oil hole 26 by driving a punch 50 for punching a hole into the peripheral wall 19 from the outside, as shown in FIG. 3. The punch 50 has a front surface formed into a linear inclined surface 51 which is inclined forward with a rising slope and an upper end serving as a sharp-pointed tooth 52.

In a punching process, firstly, the tooth 52 of the punch 50 is driven into the peripheral wall 19, so that the peripheral wall 19 is cut thereby to be formed with a cutout 35. Further thrust of the punch 50 expands the cutout 35 toward the low-pressure chamber 24. As a result, the upper end opening 37 of the pocket 27 is formed so as to spread to the low-pressure chamber 24, and the oil passage 36 of the pocket 27 is formed along the inclined surface 51 of the punch 50 so as to correspond to the inclined surface 51. The pocket 27 thus formed in the above-described manner has a slightly smaller thickness than a surrounding part of the peripheral wall 19.

The plunger oil hole 26 is formed to be upwardly inclined along the oil passage 36 of the pocket 27, so that the operating oil can be supplied into the low-pressure chamber 24 from the upper end opening 37 serving as a terminal end of the oil passage 36. Accordingly, the operating oil is stored in the low-pressure chamber 24 with the upper end opening 37 serving as an upper limit.

On the other hand, assume now a case where the plunger oil hole 26 radially extends through the peripheral wall 19 as the body oil hole 16 and has a circular or other cross section. In this case, since a surface level of the operating oil in the low-pressure chamber 24 is defined by the location of the circular lower end of the plunger oil hole 26, there is a possibility that a sufficient amount of operating oil may not be ensured in the low-pressure chamber 24 when the lash adjuster 10 is disposed in the inclined posture in the horizontal direction.

In the embodiment, however, since the surface level of the operating oil in the low-pressure chamber 24 is defined by the upper end opening 37 of the pocket 27, a sufficient amount of operating oil can be ensured in the low-pressure chamber 24 nearly up to the upper end of the plunger circumferential groove 25. Accordingly, air in the low-pressure chamber 24 can be prevented from being suctioned into the high-pressure chamber 28 when the valve hole 23 is opened to let the operating oil flow from the low-pressure chamber 24 into the high-pressure chamber 28.

In the lash adjuster 10 of the embodiment, the pocket 27 deformed into the upwardly tilted state is provided in the low-pressure chamber 24. The surface level of the operating oil in the low-pressure chamber 24 is defined by the upper end opening 37 of the pocket 27, as described above. Accordingly, an amount of operating oil in the low-pressure chamber 24 can be rendered larger than one in the case where the surface level is defined by the lower end location of the plunger oil hole 26. As a result, a sufficient amount of operating oil can be ensured in the low-pressure chamber 24 even when size reduction, an inclined arrangement of the lash adjuster 10 or the like renders storage of the operating oil in the low-pressure chamber 24 difficult. Further, the operating oil can quickly be supplied into the low-pressure chamber 24 since the cross section of the oil passage 36 of the pocket 27 is linear.

Further, the pocket 27 is formed integrally with the peripheral wall 19 in the above-described embodiment. This requires no oil feed pipe feeding the operating oil into the low-pressure chamber independently of the plunger 12 or the like, with the result that an increase in the number of parts can be prevented. Moreover, since the pocket 27 is formed simultaneously with the punching work to form the plunger oil hole 26 in the peripheral wall 19, a processing step dedicated to the forming of the pocket 27 can be eliminated with the result of reduction in the manufacturing costs.

Still further, since the cutout 35 formed on the peripheral wall 19 also serves as the upper end opening 37 of the pocket 27, the pocket 27 can easily be formed using the cutout 35. Moreover, since the cutout 35 is formed on the peripheral wall 19 along the circumferential direction, the height position of the upper end opening 37 can be raised to the maximum extent possible, with the result that a sufficient amount of operating oil can be stored in the low-pressure chamber 24.

Second Embodiment

Figure 5:
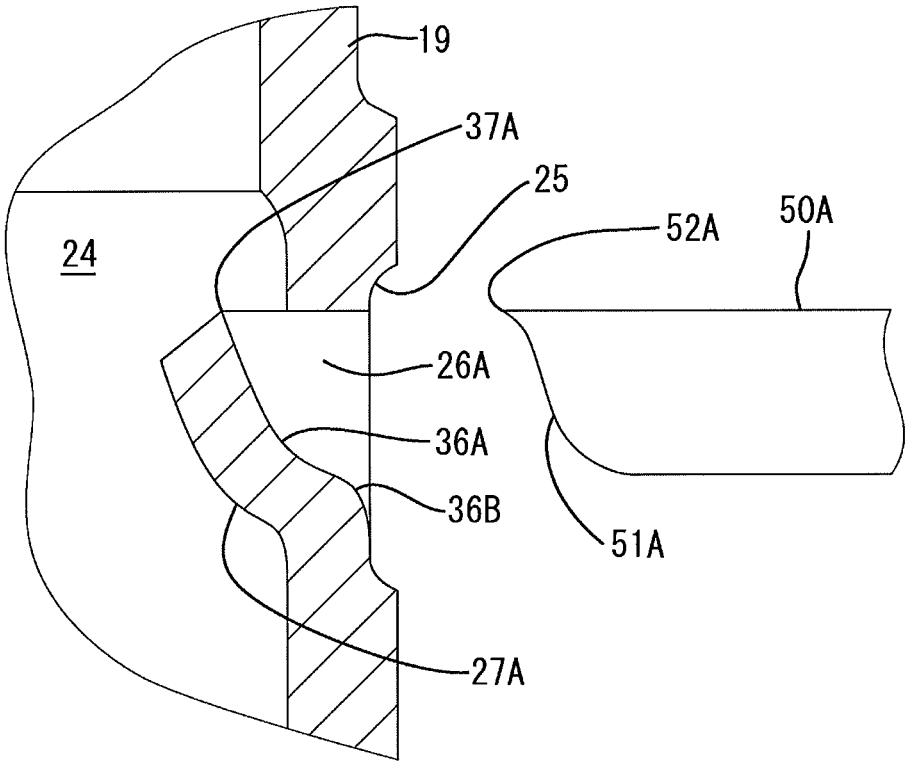
FIG. 5 is a partially enlarged sectional view of a pocket of the lash adjuster of a second embodiment.

FIG. 5 illustrates a pocket 27A in the lash adjuster of a second embodiment. The pocket 27A is formed to expand toward the low-pressure chamber 24 into a substantially quarter arc shape. The oil passage 36A of the pocket 27A is inclined from a curved beginning 36B in a lower end of the plunger circumferential groove 25 to the upper end opening 37A thereby to have a curved cross section.

The pocket 27A is formed simultaneously with the punching of the peripheral wall 19 to form the plunger oil hole 26A as in the first embodiment. In this case, the punch 50A has a front surface formed into a curvilinearly protruding inclined surface 51A and a sharp-pointed tooth 52A protruding from a front upper end of the inclined surface 51A. Further, the upper end opening 37A of the pocket 27A is formed by driving the tooth 52A of the punch 50A into the peripheral wall 19 as in the first embodiment. The oil passage 36A of the pocket 27A is formed to correspond to the inclined surface 51A of the punch 50A. Accordingly, the surface level of the operating oil in the low-pressure chamber 24 is defined by the upper end opening 37A of the pocket 27A. As a result, since the surface level is raised near the upper end of the plunger circumferential groove 25, a sufficient amount of operating oil can be ensured in the low-pressure chamber 24.

In the second embodiment, the oil passage 36A of the pocket 27A is formed so as to expand toward the low-pressure chamber 24. This can increase an amount of operating oil passing through the oil passage 36A per unit time, with the result that the operating oil in the low-pressure chamber 24 can be prevented from occurrence of cavitation.

Other Embodiments (1) In forming the pocket, a step of cutting out the peripheral wall may be carried out at intervals independent of a step of deforming the peripheral wall.

(2) The lash adjuster may normally be disposed along the vertical direction. More specifically, an axis line of the peripheral wall may normally be directed in the vertical direction. In this case, too, there is a possibility that air in the low-pressure chamber may be suctioned into the high-pressure chamber when the lash adjuster is temporarily inclined sideways due to the stop of a vehicle on a slope or the like. Accordingly, applying the present invention has a conspicuous advantage. Although the axis line of the peripheral wall is directed in a inclined direction approximate to a horizontal direction in each of the foregoing embodiments, the axis line of the peripheral wall may be directed in the horizontal direction in the present invention.

(3) The pocket may have an oil passage with a substantially L-shaped cross section.

What is claimed is:

1. A lash adjuster comprising:

a body which is cylindrical in shape; and a plunger reciprocably inserted into the body and having an interior in which a low-pressure chamber is defined, the plunger having a bottom wall defining a high-pressure chamber in conjunction with the body therebetween and a peripheral wall formed with a plunger oil hole through which an operating oil is fed into the low-pressure chamber, the bottom wall being formed with a valve hole through which the operating oil stored in the low-pressure chamber is allowed to flow into the high-pressure chamber, the plunger having a pocket provided on the peripheral wall so as to be deformed toward the low-pressure chamber and so as to be inclined in an upward direction, thereby defining the plunger oil hole, wherein the pocket has a recessed outer surface inclined with a rising slope and formed into an oil passage for the operating oil, the recessed outer surface constituting a hole surface of the plunger oil hole.

2. The lash adjuster according to claim 1, wherein the peripheral wall is formed with a cutout which serves as an upper end opening of the pocket.

3. The lash adjuster according to claim 2, wherein the cutout is formed along a circumferential direction on the peripheral wall.

4. The lash adjuster according to claim 1, wherein the pocket has an oil passage protruding toward the low-pressure chamber and has a linear cross section.

5. The lash adjuster according to claim 1, wherein the pocket has an oil passage expanding toward the low-pressure chamber and has a curved cross section.

6. The lash adjuster according to claim 1, wherein the peripheral wall of the plunger has an axis line directed in a horizontal direction or a direction of inclination approximate to the horizontal direction.

7. The lash adjuster according to claim 1, wherein, in addition to the peripheral wall formed with the plunger oil hole, the plunger has an upper end spherical portion, and the plunger is a monolithic, one piece plunger.

8. The lash adjuster according to claim 1, wherein the plunger further comprises a circumferential groove formed on an outer surface of the peripheral wall, and which circumferential groove is in oil flow communication with the plunger oil hole, and wherein the rising slope of the recessed outer surface has a free upper edge that falls, relative to an axial direction of the plunger, between an upper end and a lower end of the circumferential groove.

9. The lash adjuster according to claim 8, wherein the free upper edge, relative to the axial direction of the plunger, is closer to the upper end than the lower end of the circumferential groove.

* * * * *